US008479672B2

(12) United States Patent
Kawai

(10) Patent No.: US 8,479,672 B2
(45) Date of Patent: Jul. 9, 2013

(54) SEWING MACHINE

(75) Inventor: Yasunori Kawai, Nagoya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 13/398,077

(22) Filed: Feb. 16, 2012

(65) Prior Publication Data

US 2012/0210924 A1 Aug. 23, 2012

(30) Foreign Application Priority Data

Feb. 21, 2011 (JP) ..... 2011-034457

(51) Int. Cl.
*D05B 47/00* (2006.01)

(52) U.S. Cl.
USPC ..... 112/254

(58) Field of Classification Search
USPC ..... 112/254, 255, 258, 272, 273, 302; 242/150 R, 419.4, 419.5
See application file for complete search history.

(56) References Cited

U.S. PATENT DOCUMENTS

| | | | | |
|---|---|---|---|---|
| 1,581,093 | A * | 4/1926 | Howie | 66/99 |
| 3,190,249 | A | 6/1965 | Gegauf, Jr. | |
| 3,721,205 | A | 3/1973 | Ono et al. | |
| 5,191,847 | A * | 3/1993 | Kojima et al. | 112/254 |
| 5,377,606 | A * | 1/1995 | Fujita | 112/254 |
| 7,430,973 | B2 * | 10/2008 | Wakazono | 112/254 |

FOREIGN PATENT DOCUMENTS

| | | |
|---|---|---|
| DE | 1 485 156 | 7/1969 |
| JP | 7-68068 | 3/1995 |
| JP | 7-284584 | 10/1995 |
| JP | 8-150277 | 6/1996 |
| JP | 8-309062 | 11/1996 |
| JP | 2000-210489 | 8/2000 |
| JP | 2011-50460 | 3/2011 |

OTHER PUBLICATIONS

Extended Search Report issued May 18, 2012 in European Application No. 12155821.7.

* cited by examiner

*Primary Examiner* — Tejash Patel
(74) *Attorney, Agent, or Firm* — Oblon, Spivak, McClelland, Maier & Neustadt, L.L.P.

(57) ABSTRACT

A sewing machine includes a needle thread tension control device including a fixed portion, a shaft having an external thread portion, a thread tension dial, first and second thread tension discs, and a spiral movement member. The spiral movement member includes an internal thread portion meshed with the external thread portion while being movable relative to the external thread portion in a spiral direction relative to the axis, and a scale including marks arranged serially and side by side in the spiral direction. The spiral movement member adjusts the needle thread tension by moving towards or away from the second thread tension disc while rotating in a circumferential direction by meshing between the external thread portion and the internal thread portion. The needle thread tension control device also includes a thread tension spring applying respective biasing forces to the spiral movement member and the second thread tension disc.

4 Claims, 9 Drawing Sheets

SEWING MACHINE

CROSS REFERENCE TO RELATED APPLICATIONS

This application is based on and claims priority under 35 U.S.C. §119 to Japanese Patent Application 2011-034457, filed on Feb. 21, 2011, the entire content of which is incorporated herein by reference.

TECHNICAL FIELD

This disclosure generally relates to a sewing machine. More particularly, the disclosure pertains to a sewing machine including a needle thread tension control device that controls a needle thread tension.

BACKGROUND DISCUSSION

A known sewing machine such as illustrated in FIG. 15 is disclosed in JP08-309062A (hereinafter referred to as Reference 1), for example. Specifically, a sewing machine 100 disclosed in Reference 1, and illustrated in FIG. 15 includes a base frame 101 to which a thread tensioner 110 (a needle thread tension control device) is fixed by a screw 103. A portion of an operation dial 117 of the thread tensioner 110 projects from an opening 102*a* of an external cover 102 of the sewing machine 100.

FIG. 16 is an explanatory view of the thread tensioner 110 illustrated in FIG. 15. As illustrated in FIG. 16, one end of a thread tension shaft 112 including a lead screw portion 112*a* is fixed to a thread tension bracket 111 of the thread tensioner 110. A pair of tension discs 113, 113 sandwiching and holding a needle thread so as to apply a tensile force (a tension), a tension spring 114, a spring retainer 115, a pressing spring 116, and the operation dial 117 are assembled from the other end of the thread tension shaft 112 so as to be positioned at the thread tension shaft 112 in the aforementioned order from the one end to the other end of the thread tension shaft 112. A stopper 118 is provided to block the operation dial 117 from disengaging from the thread tension shaft 112 at a time when the sewing machine 100 is assembled. The tension spring 114 applies a spring load to the pair of tension discs 113, 113 while the pressing spring 116 applies a spring load to the operation dial 117. The operation dial 117 includes two cylindrical portions coaxially arranged to the thread tension shaft 112. One of the cylindrical portions positioned at an inner side includes a groove 117*a* in parallel to the thread tension shaft 112. An outer peripheral end portion 115*a* of the spring retainer 115 engages with the groove 117*a*. Numeric values indicating a needle thread tension setting level are illustrated on an outer peripheral surface 117*p* of the operation dial 117. In a case where a user of the sewing machine 100 rotates the operation dial 117 within one rotation range thereof, the spring retainer 115 rotates in association with the operation dial 117 while sliding in an axial direction of the thread tension shaft 112 relative to the operation dial 117. As a result, a distance between the pair of tension discs 113, 113 and the spring retainer 115 changes, which causes a change in a pressing load applied to the pair of tension discs 113, 113. The needle thread tension is adjusted and controlled accordingly. According to the sewing machine 100 equipped with the thread tensioner 110, in a state where the external cover 102 is attached to the base frame 101, the portion of the operation dial 117 projects from the opening 102*a* of the external cover 102. In addition, an end surface 117*b* of the operation dial 117 arranged at a right side in FIG. 16 is in contact with an end surface 102*b* of the opening 102*a* arranged at the right side.

Further, JP07-284584A (hereinafter referred to as Reference 2) discloses another thread tensioner where a display of a scale is changeable by a simple rotation of a ring, without an actual change of the needle thread tension, in a state where an operation dial is fixed. According to the thread tensioner disclosed in Reference 2, the display of the scale should fully appear on an outer periphery of the ring corresponding to one rotation angle thereof.

According to the thread tensioner 110 disclosed in Reference 1, the numeric values indicating the needle thread tension setting level appear on the outer peripheral surface 117*p* of the operation dial 117 in a circumferential direction thereof, instead of a spiral direction. That is, the display of the scale indicating the needle thread tension is limited within a range corresponding to one rotation of the operation dial 117 about an axis thereof. That is, a distance from a start point to an end point of the scale is limited within a range corresponding to 360° of the operation dial 117 on the outer peripheral surface 117*p*. As a result, the distance from the start point (a maximum tensile value) to the end point (a minimum tensile value) of the scale is inhibited from being elongated. In this case, the scale indicating the needle thread tension is inhibited from being finely specified. Further, because the display of the scale is limited within the range corresponding to one rotation of the operation dial 117 about the axis thereof, the maximum tensile value may be inhibited to increase. Even in such case, an increase of an outer diameter of the operation dial 117 achieves an increase of a peripheral length of the outer peripheral surface 117*p* of the operation dial 117, which leads to an increase of the distance from the start point to the end point of the scale. However, an excessive enlargement of the outer diameter of the operation dial 117 may occur.

According to the thread tensioner disclosed in Reference 2, the scale indicating the needle thread tension should fully appear on the outer periphery of the ring corresponding to one rotation angle thereof. Therefore, a distance from a start point (a maximum tension value) to an end point (a minimum tension value) of the scale is limited within a range corresponding to 360° of the ring and is inhibited from being elongated. The scale indicating the needle thread tension is inhibited from being finely specified.

A need thus exists for a sewing machine which is not susceptible to the drawback mentioned above.

SUMMARY

According to an aspect of this disclosure, a sewing machine includes a base member, and a needle thread tension control device provided at the base member. The needle thread tension control device includes a fixed portion fixed to the base member and including a display window displaying a needle thread tension, a shaft fixed to the fixed portion in a state where a rotation of the shaft about an axis of the shaft is inhibited, the shaft including an external thread portion, a thread tension dial provided at a second end of the shaft in an axial direction where the axis extends and being rotatable about the axis, a first thread tension disc provided at a first end of the shaft in the axial direction, a second thread tension disc provided at the shaft so as to be movable in the axial direction of the shaft and holding a needle thread with the first thread tension disc, and a spiral movement member held at the shaft and engaging with the thread tension dial to rotate in association with a rotation of the thread tension dial. The spiral movement member includes an internal thread portion meshed with the external thread portion of the shaft while being movable relative to the external thread portion in a spiral direction relative to the axis, and a scale including marks arranged serially and side by side in the spiral direction relative to the axis to indicate a magnitude of the needle thread tension. The spiral movement member adjusts the needle thread tension by moving towards the second thread tension disc or away from the second thread tension disc in the axial direction along the shaft while rotating in a circumferential direction of the spiral movement member about the axis by meshing between the external thread portion and the internal thread portion. The spiral movement member displays the scale indicating a present needle thread tension by causing the scale to be exposed from the display window. The needle thread tension control device also includes a thread tension spring arranged between the spiral movement member and the second thread tension disc and applying respective biasing forces to the spiral movement member and the second thread tension disc in opposite directions from each other.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A sewing machine includes a base member having a needle bar at which a needle is attached and which is movable in upward and downward directions and a lifting mechanism moving the needle in the upward and downward directions, and a needle thread tension control device provided at the base member. The base member generally includes a work supporting bed, a vertical arm portion, and a lateral arm portion. A fixed portion, which is fixed to the base member (for example, to the lateral arm portion), includes a display window displaying a needle thread tension (a needle thread tension setting level). A spiral movement member is held by a shaft so as to be rotatable in association with a rotational operation of a thread tension dial. The spiral movement member includes an internal thread portion meshed with an external thread portion formed at the shaft so as to move in both directions of the shaft along an axis thereof, and a scale indicating a magnitude of the needle thread tension by numerical values, for example, arranged serially and side by side in a spiral direction relative to the axis of the shaft. Because of the meshing between the external thread portion of the shaft and the internal thread portion of the spiral movement member, the spiral movement member moves relative to the external thread portion in the meshed manner, i.e., the spiral movement member moves towards or away from a second thread tension disc in an axial direction along the shaft while rotating in a circumferential direction about the axis. Accordingly, one of the numerical values of the scale indicating a present needle thread tension (a present needle thread tension setting level) is exposed and visible at the display window. The spiral movement member includes a tension setting portion coaxially held at the shaft and movable in both directions of the shaft along the axis while rotating about the axis, and a tension display portion operating in association with the tension setting portion. In this case, the tension setting portion includes the internal thread portion while the tension display portion includes the scale that is exposed at the display window. The spiral movement member may be formed by plural members or by a single member. For example, the spiral movement member includes a first member including the internal thread portion meshed with the external thread portion of the shaft and a second member including the scale and operating in association with the first member.

[First Embodiment]

Figure 1:
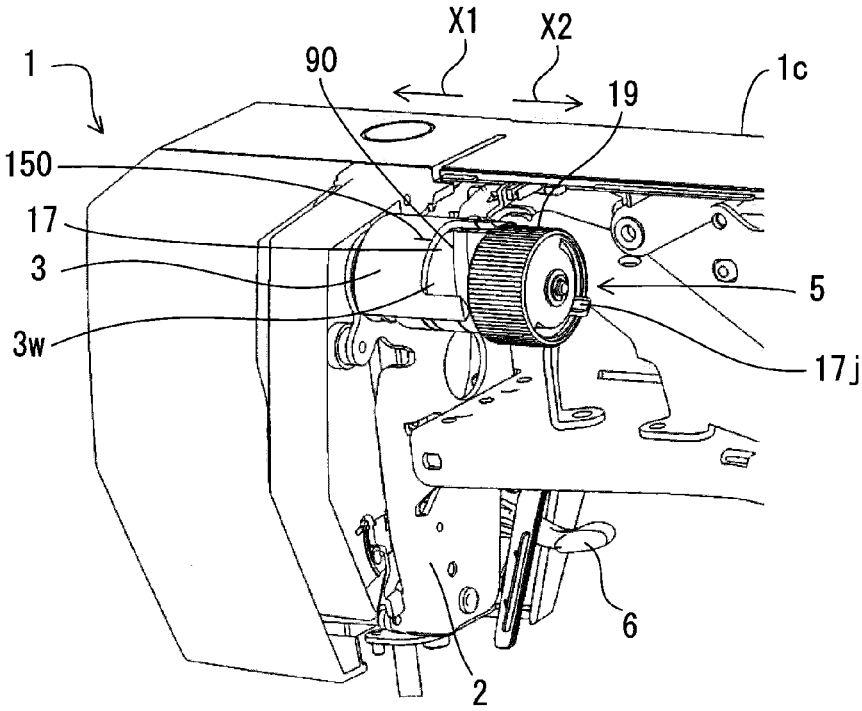
FIG. 1 is a perspective view in the vicinity of a thread tension dial of a sewing machine including a needle thread tension control device according to a first embodiment disclosed here.

A first embodiment will be explained with reference to the attached drawings. As illustrated in FIG. 1, a sewing machine 1 of the first embodiment includes a lateral arm 1*c* serving as a portion of the base member that has a frame 2 serving as a portion of the fixed portion. The frame 2 includes a case 3 serving as a portion of the fixed portion and including a display window 3*w* that is exposed to the outside so as to be seen from a user of the sewing machine 1. A needle thread tension control device 5 operated by the user so as to adjust the needle thread tension (needle thread tension level) is provided at the frame 2.

Figure 2:
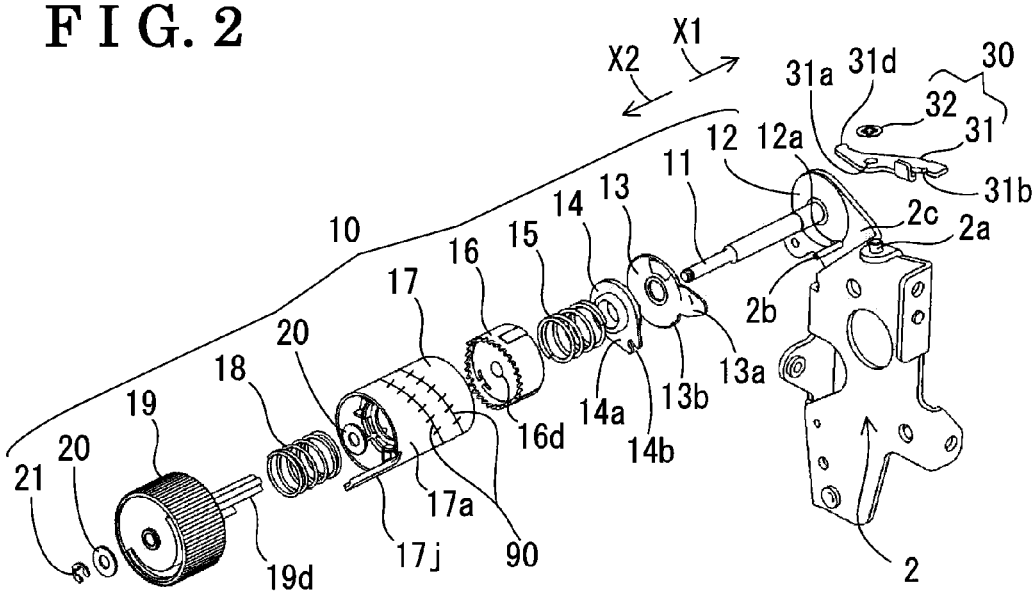
FIG. 2 is an exploded perspective view of the needle thread tension control device illustrated in FIG. 1.
Figure 3A:
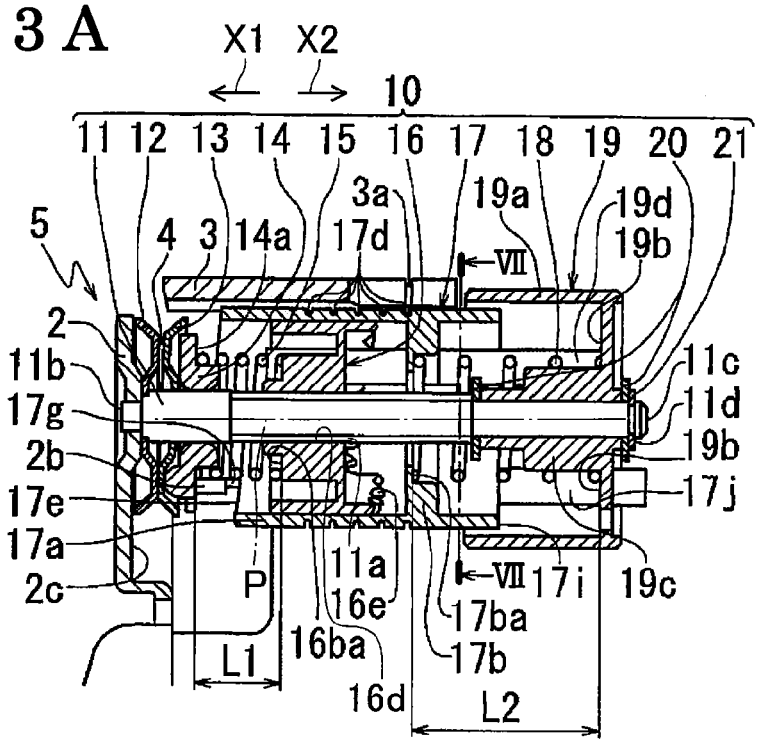
FIG. 3A is a cross-sectional view of the needle thread tension control device illustrating a state where a needle thread tension is at a maximum according to the first embodiment.
Figure 3B:
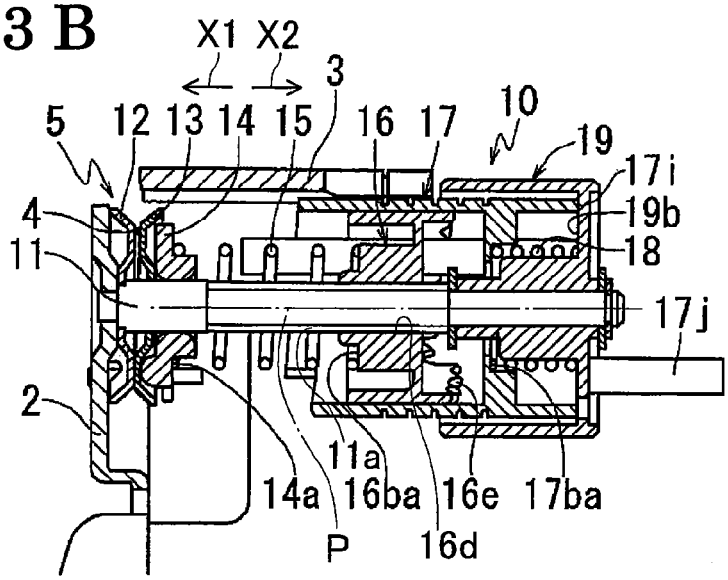
FIG. 3B is a cross-sectional view of the needle thread tension control device illustrating a state where the needle thread tension is at a minimum according to the first embodiment.

As illustrated in FIG. 2, the needle thread tension control device 5 includes a tension control portion 10 controlling or adjusting the needle thread tension and a thread release portion 30 releasing and attaching a needle thread 4. As illustrated in FIGS. 2, 3A and 3B, the tension control portion 10 includes a shaft 11 having an axis P, a thread tension dial 19, a first thread tension disc 12, a second thread tension disc 13, a tension setting nut 16, a tension display portion 17, and a thread tension spring 15 formed into a coil spring shape. The tension setting nut 16 serves as the tension setting portion and the spiral movement member. The tension display portion 17 integrally moves with the tension setting nut 16 in a circumferential direction and an axial direction (arrows X1 and X2 directions). The tension display portion 17 serves as the spiral movement member. As illustrated in FIGS. 3A and 3B, a first end 11 b of the shaft 11 in the axial direction where the axis P extends is fixed to the frame 2 of the sewing machine 1. Thus, the shaft 11 is inhibited from moving in the axial direction (in the arrows X1 and X2 directions) and from rotating around the axis P. In a case where the user rotates the thread tension dial 19 in an upper direction (a first direction) or a lower direction (a second direction) in FIG. 1 about the axis P in the circumferential direction, the tension display portion 17 of the needle thread tension control device 5 moves within the display window 3*w* in a left direction (a first axial direction) or a right direction (a second axial direction) in FIG. 1 depending on a rotation angle of the thread tension dial 19, thereby adjusting the needle thread tension. The thread tension dial 19 is rotatable, however, is inhibited from moving in the axial direction (the arrows X1 and X2 directions). Because the shaft 11, the tension setting nut 16, the thread tension dial 19, the tension display portion 17 are coaxially arranged relative to the axis P, the axis P serves as the axis for all of the tension setting nut 16, the thread tension dial 19, and the tension display portion 17.

As illustrated in FIG. 2, the thread release portion 30 releases the needle thread tension by separating the first thread tension disc 12 and the second thread tension disc 13. The thread release portion 30 includes a thread release plate 31 and a retaining ring 32. A shaft 2*a* formed at the frame 2 is inserted into a hole 31*a* formed at the thread release plate 31 and thereafter the retaining ring 32 is mounted at the shaft 2*a*. As a result, the thread release plate 31 is inhibited from disengaging form the shaft 2*a*. An end portion of a lever connected to an end of a presser foot lever 6 (see FIG. 1) is positioned at a groove 31*b* formed at the thread release plate 31. In a case where the presser foot lever 6 moves upwardly from an original position thereof, the end portion of the lever connected to the end of the presser foot lever 6 makes contact with the groove 31*b* of the thread release plate 31. The thread release plate 31 then rotates about the shaft 2*a*. The rotation of the thread release plate 31 causes an acting point 31*d* of the thread release plate 31 to make contact with an acting portion 13*a* formed at the second thread tension disc 13 extending from an outer peripheral side thereof. A clearance is then formed between the first and second thread tension discs 12 and 13. As a result, the needle thread tension is released, thereby removing and attaching the needle thread 4. In a case where the presser foot lever 6 is returned to the original position, the second thread tension disc 13 is returned to its original position so that the needle thread tension is recovered.

As illustrated in FIGS. 2, 3A, and 3B, the tension control portion 10 further includes a spring bearing 14, an operation stability spring 18 having a coil shape, a pair of flat washers 20, 20 provided at both ends of a second cylindrical portion 19*c* of the thread tension dial 19, and a retaining ring 21 attached to a groove 11*d* formed at a second end 11*c* of the shaft 11.

The first end 11*b* of the shaft 11 where the first thread tension disc 12 is assembled is fixed to the frame 2 so that the shaft 11 is inhibited from rotating about the axis P and from moving in the axial direction (the arrows X1 and X2 directions). The first thread tension disc 12 is held between the frame 2 and the shaft 11 accordingly. An external thread portion 11*a* is formed at a substantially center portion of the shaft 11. The tension setting nut 16 includes an internal thread portion 16*d* formed around the axis P. The internal thread portion 16*d* is meshed with the external thread portion 11*a* in a state to be movable in the axial direction relative to the external thread portion 11*a*. The tension setting nut 16, which is rotatable about the axis P, is movable in the axial direction while rotating. As illustrated in FIGS. 3A and 3B, the second thread tension disc 13, the spring bearing 14, and the thread tension spring 15 are assembled on the shaft 11 between the first thread tension disc 12 and the tension setting nut 16 and positioned in the aforementioned order from the first end 11*b* to a direction away from the first end 11*b*. The thread tension spring 15 applies biasing forces to the tension setting nut 16 and to the first thread tension disc 12 respectively. Directions of the biasing forces applied to the tension setting nut 16 and the first thread tension disc 12 are opposite from each other. In the aforementioned state, both ends of the thread tension spring 15 are in contact with a surface 14*a* of the spring bearing 14 and a surface 16*ba* of the tension setting nut 16. The second thread tension disc 13 receives the biasing force (hereinafter referred to as a spring load) from the thread tension spring 15 in the arrow X1 direction via the spring bearing 14. The second thread tension disc 13 contacts or approaches the first thread tension disc 12, which results in the needle thread 4 sandwiched and held between the first and second thread tension discs 12 and 13. Then, in a case where the tension setting nut 16 rotates in the circumferential direction about the axis P, a length L1 between the surface 14*a* of the spring bearing 14 and the surface 16*ba* of the tension setting nut 16 changes. Therefore, the spring load of the thread tension spring 15 pressing the second thread tension disc 13 changes, which causes a change in frictional force between the needle thread 4 and the first and second thread tension discs 12 and 13, i.e., causes a change in the tension of the needle thread 4. When the frictional force between the needle thread 4 and the first and second thread tension discs 12 and 13 increases or decreases, the tension of the needle thread 4 increases or decreases accordingly.

Figure 4A:
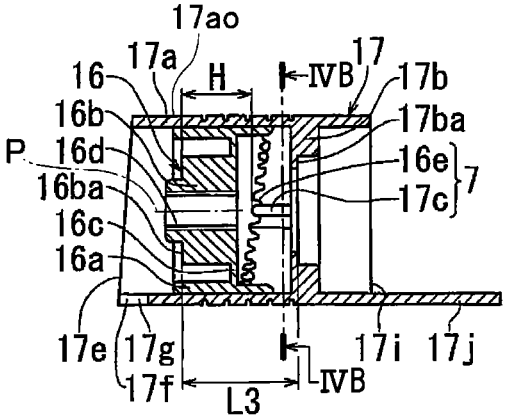
FIG. 4A is an explanatory view of an engagement portion between a tension setting nut and the tension display portion according to the first embodiment.
Figure 4B:
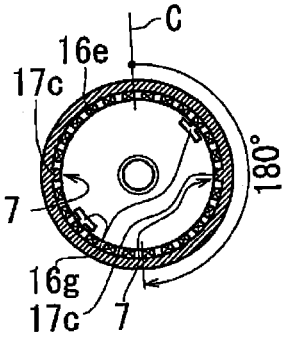
FIG. 4B is a cross-sectional view taken along the line IVB-IVB in FIG. 4A.

FIG. 4A explains an engagement portion between the tension setting nut 16 and the tension display portion 17 while omitting the shaft 11 for an easy explanation. FIG. 4B is a cross-sectional view taken along the line IVB-IVB in FIG. 4A. Each cross mark (X-mark) in FIG. 4B indicates a base portion of a notch recess 16*e* serving as a first engagement portion (to be explained later). In this case, the cross mark is omitted for the base portion of the notch recess 16*e* that engages with a notch protrusion 17*c* serving as a second engagement portion (to be explained later). As illustrated in FIG. 4A, the tension setting nut 16 having a cylindrical shape includes a cylindrical portion 16*a*, a boss portion 16*b*, and a circular plate portion 16*c*. The boss portion 16*b* includes the internal thread portion 16*d* formed at an inner periphery of the cylindrical portion 16*a*. The circular plate portion 16*c* connects the cylindrical portion 16*a* and the boss portion 16*b*. The surface 16*ba* formed at a dent portion of the boss portion 16*b* is in contact with an end surface of the thread tension spring 15. The internal thread portion 16*d* of the tension setting nut 16 is meshed with the external thread portion 11*a* of the shaft 11 in a state to be movable in the axial direction relative to the external thread portion 11*a*. That is, the tension setting nut 16 moves in a spiral direction relative to the axis P. Even when the internal thread portion 16*d* moves relative to the external thread portion 11*a* while being meshed therewith, the shaft 11 is inhibited from rotating or moving in the axial direction. Consequently, the tension setting nut 16 moves in the arrow X1 or X2 direction while rotating.

Figure 5:
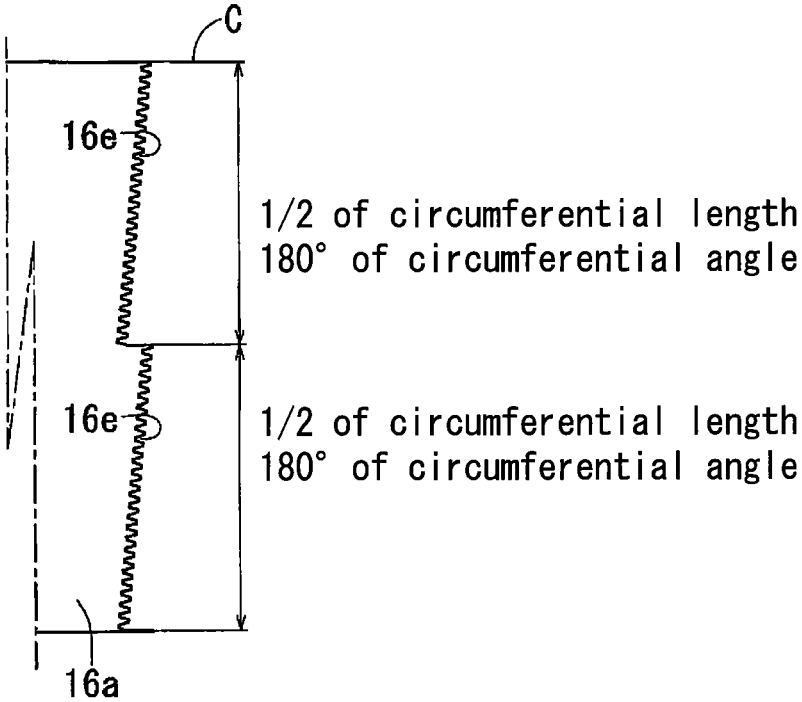
FIG. 5 is a partial development view of an outer peripheral surface of a cylindrical portion of the tension setting nut according to the first embodiment.

As illustrated in FIGS. 4A and 4B, a plurality of the notch recesses (the plural notch recesses) 16*e* having even pitches therebetween are formed at one end surface (i.e., a right end surface in FIG. 4A) of the cylindrical portion 16*a* of the tension setting nut 16. Specifically, a distance H defined between the surface 16*ba* and each of the notch recesses 16*e* gradually increases in a case where each of the notch recesses 16*e* is positioned away from a line C (see FIG. 5) (i.e., away in a clockwise direction within 180° of a center angle of the cylindrical portion 16*a* relative to the line C as illustrated in FIG. 4B). The plural notch recesses 16*e* form a group of notch recesses. As illustrated in FIG. 5, in a state where the outer peripheral surface of the cylindrical portion 16*a* of the tension setting nut 16 is developed, a line connecting plural base portions of the notch recesses 16*e* and a line connecting peak portions of the notch recesses 16*e* incline in the substantially same degrees as each other in a range obtained by dividing a circumferential length of the cylindrical portion 16*a* by two (i.e., 180° of the center angle of the cylindrical portion 16*a*). Then, two of the groups of notch recesses, each being in the range of 180° of the center angle of the cylindrical portion 16*a* are formed while being displaced by 180° from each other, at the outer peripheral surface of the cylindrical portion 16*a* as illustrated in FIG. 4B. As a result, each pair of notch recesses 16*e*, 16*e* displaced by 180° from each other is formed at the right end surface of the cylindrical portion 16*a* in FIG. 4A. The distance H from the surface 16*ba* to one of the pair of notch recesses 16*e* and the distance H from the surface 16*ba* to the other of the pair of notch recesses 16*e* displaced by 180° from each other are the same.

As illustrated in FIGS. 4A and 4B, the tension display portion 17 having the cylindrical shape is fitted to the cylindrical portion 16*a* of the tension setting nut 16 from the outside thereof. The tension display portion 17 includes a cylindrical portion 17*a*, an annular plate portion 17*b*, and plural notch protrusions 17*c* (specifically, according to the present embodiment, a pair of notch protrusions 17*c*, 17*c*). The annular plate portion 17*b* is formed at a portion of an inner peripheral surface of the cylindrical portion 17*a* in the axial direction. The pair of notch protrusions 17*c*, 17*c* extends in the left direction (the first axial direction) in FIG. 4A relative to the annular plate portion 17*b* while slightly projecting in a radially inner direction from the inner peripheral surface of the cylindrical portion 17*a*. The pair of notch protrusions 17*c*, 17*c* is formed at the inner peripheral surface of the cylindrical portion 17*a* in a state to be displaced by 180°. In addition, a distance from a tip end of one of the pair of notch protrusions 17*c* to a surface 17*ba* and a distance from a tip end of the other of the pair of notch protrusions 17*c* to the surface 17*ba* are substantially the same. The surface 17*ba*, which is a surface of a dent portion of the annular plate portion 17*b*, is in contact with an end surface of the operation stability spring 18.

An inner surface of a portion 17*ao* (which is provided at a left side in FIG. 4) of the cylindrical portion 17*a* of the tension display portion 17 is coaxially fitted to the outer peripheral surface of the cylindrical portion 16*a* of the tension setting nut 16. One of the pairs of the notch recesses 16*e*, 16*e* of the tensions setting nut 16 engages with the pair of notch protrusions 17*c*, 17*c* of the tension display portion 17. As a result, the tension setting nut 16 and the tension display portion 17 operate in association with each other.

A distance L3 in FIG. 4A defined between the surface 16*ba* of the tension setting nut 16 and the surface 17*ba* of the tension display portion 17 is adjustable depending on which pair of notch recesses 16*e*, 16*e* engage with the notch protrusions 17*c*, 17*c*. The adjustment of the distance L3 may achieve an adjustment of a relative assembled position between the tension setting nut 16 and the tension display portion 17 in a direction parallel to the axis P. The spring load of the thread tension spring 15 may be finely adjusted upon assembly or maintenance, for example. As a result, variations of the spring load of the thread tension spring 15 may be restrained.

The engagement between the pair of notch recesses 16*e*, 16*e*, and the pair of notch protrusions 17*c*, 17*c* form an engagement portion 7. A rotation of the tension setting nut 16 is transmitted to the tension display portion 17 by means of the engagement portion 7. The tension setting nut 16 and the tension display portion 17 operate together accordingly. Further, the pair of notch recesses 16*e*, 16*e* are pressed via the pair of notch protrusions 17*c*, 17*c* by a spring load of the operation stability spring 18 so that the movement of the tension setting nut 16 in the axial direction is transmitted to the tension display portion 17. In a case where the tension setting nut 16 moves about the axis P in a state where the internal thread portion 16*d* is meshed with the external thread portion 11*a*, the tension display portion 17 also rotates about the axis P and moves in the axial direction in association with the tension setting nut 16. That is, in a case where the tension setting nut 16 rotates about the axis P and moves in the axial direction, the tension display portion 17 also rotates about the axis P and moves in the axial direction.

As illustrated in FIGS. 3A and 3B, one of the flat washers 20, the thread tension dial 19, the other of the flat washers 20 are assembled on the second end 11*c* of the shaft 11 and positioned in the aforementioned order. The thread tension dial 19 is inhibited from disengaging from the shaft 11 by means of the retaining ring 21 attached to the groove 11*d* of the shaft 11. In addition, the thread tension dial 19 is rotatable relative to the shaft 11 about the axis P. The thread tension dial 19 is rotatable about the axis P, however, is not movable in the axial direction (the arrows X1 and X2 directions).

As illustrated in FIGS. 3A and 3B, the operation stability spring 18 is provided between the surface 17*ba* of the tension display portion 17 and a surface 19*b* formed at an inner side of the thread tension dial 19 in a state where the operation stability spring 18 is guided by an outer peripheral surface of the second cylindrical portion 19*c* of the thread tension dial 19. Both end surfaces of the operation stability spring 18 are in pressure-contact with the surfaces 17*ba* and 19*b*, respectively. The thread tension dial 19 is pressed by the spring load of the operation stability spring 18. A frictional force caused by the spring load of the operation stability spring 18 is generated between the thread tension dial 19 and each of the flat washers 20. At this time, however, the flat washer 20 serves as a sliding member to thereby greatly reduce the frictional force.

Figure 6:
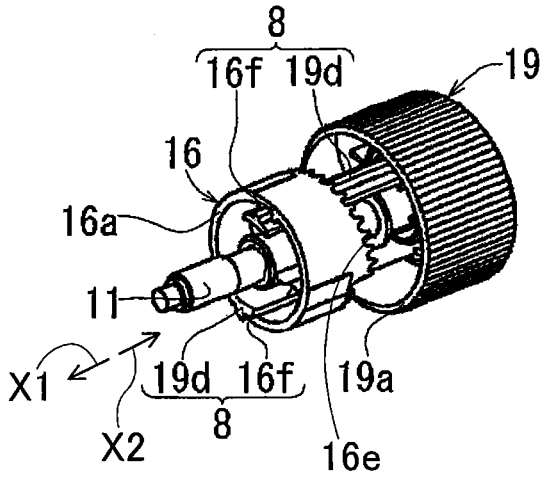
FIG. 6 is a perspective view explaining an attachment of the tension setting nut and a thread tension dial according to the first embodiment.
Figure 7:
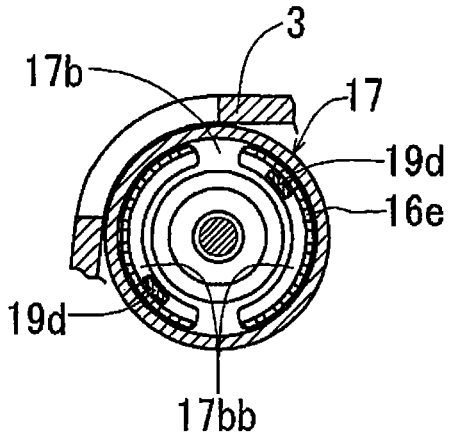
FIG. 7 is a cross-sectional view taken along the line VII-VII in FIG. 3A.

As illustrated in FIGS. 2, 3A and 3B, the thread tension dial 19 includes slide rails 19*d* (engagement projections) between a first cylindrical portion 19*a* and the second cylindrical portion 19*c*. As illustrated in FIG. 7 where the operation stability spring 18 is omitted for an easy explanation, each of the slide rails 19*d* penetrates through an elongated bore 17*bb* formed at the annular plate portion 17*b* of the tension display portion 17 and a hole 16*g* (see FIG. 4B) formed at the circular plate portion 16*c* of the tension setting nut 16. Further, each of the slide rails 19*d* is inserted into a slide rail groove 16*f* (see FIG. 6) formed at the inner peripheral surface of the cylindrical portion 16*a* of the tension setting nut 16. The elongated bore 17*bb* has an arc shape and serves as a first engagement portion. The hole 16*g* serves as a second engagement portion. The slide rail groove 16*f* serves as a third engagement portion. The engagement between the slide rail 19*d* and the slide rail groove 16*f* form a conversion mechanism 8 as illustrated in FIG. 6. According to the conversion mechanism 8, in a case where the thread tension dial 19 rotates in the circumferential direction thereof about the axis P, the tension setting nut 16 rotates in the same direction as the thread tension dial 19 while the slide rail 19*d* is sliding in the slide rail groove 16*f*. In this case, the tension setting nut 16 moves in the axial direction relative to the thread tension dial 19 depending on a rotation angle of the thread tension dial 19. Because of the sliding of the slide rail 19*d* the tension setting nut 16 is allowed to move in the axial direction relative to the thread tension dial 19. The slide rail groove 16*f* may be provided at the tension display portion 17. Further alternatively, the slide rail 19*d* may be provided at the tension setting nut 16 or the tension display portion 17 while the slide rail groove 16*f* may be provided at the thread tension dial 19.

Figure 8:
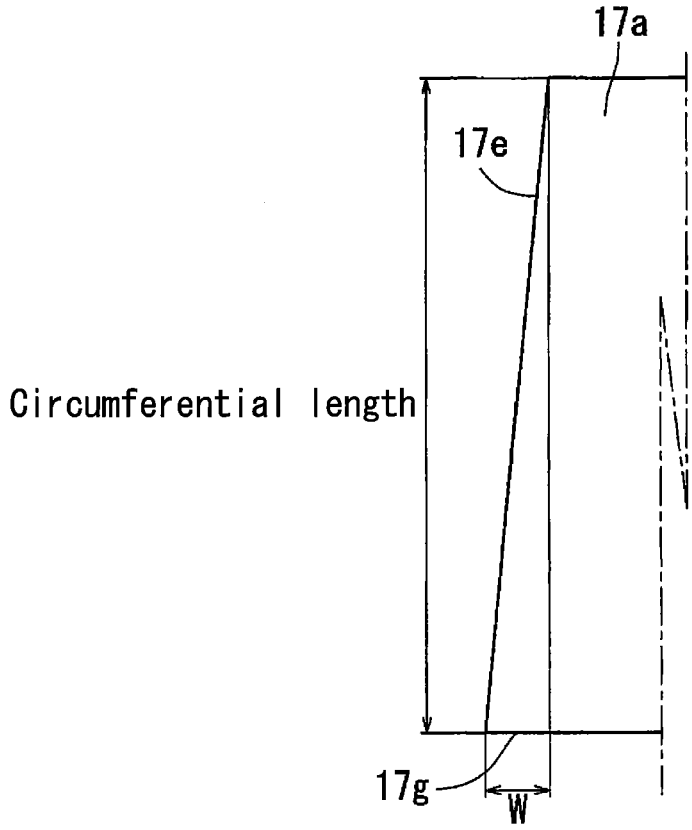
FIG. 8 is a partial development view of an outer peripheral surface of a cylindrical portion of the tension display portion according to the first embodiment.

A stopper mechanism to stop the rotation of the thread tension dial 19 will be explained below. As illustrated in FIG. 2, a stopper 2*b* is formed at a surface 2*c* of the frame 2 by vertically extending therefrom. The stopper 2*b* penetrates through respective grooves 12*a*, 13*b*, and 14*b* formed at the first and second thread tension discs 12 and 13, and the spring bearing 14 so as to project from the surface 14*a* of the spring bearing 14 as illustrated in FIGS. 3A and 3B. As illustrated in FIG. 8, a first end surface 17*e* of the cylindrical portion 17*a* of the tension display portion 17 is formed into a linear shape so as to incline relative to a second end surface 17*i* (see FIGS. 3A and 4A) of the cylindrical portion 17*a*. Thus, as illustrated in FIG. 4A, a cut portion 17*f* having a helix shape is formed at the first end surface 17*e*. The cut portion 17*f* forms a stopper surface 17*g* (which corresponds to a range W indicated by arrows in FIG. 8) in parallel to the stopper 2*b*. In a case where the thread tension dial 19 rotates in a direction where the spring load of the thread tension spring 15 increases, the stopper surface 17*g* of the tension display portion 17 makes contact with the stopper 2*b* as illustrated in FIG. 3A to thereby stop the rotation of the thread tension dial 19. As a result, the needle thread tension reaches a maximum value.

On the other hand, in a case where the thread tension dial 19 rotates in the circumferential direction thereof to a side where the spring load of the thread tension spring 15 decreases, the second end surface 17*i* of the tension display portion 17 makes contact with the surface 19*b* of the thread tension dial 19 as illustrated in FIG. 3B to thereby stop the rotation of the thread tension dial 19. As a result, the needle thread tension reaches a minimum value. The rotation angle of the thread tension dial 19 is ensured to be 360° (one rotation) or greater from the minimum value to the maximum value of the needle thread tension. According to the present embodiment, the rotation angle of the thread tension dial 19 is equal to 360°×n (n=2; i.e., 720°) from the minimum value to the maximum value of the needle thread tension. The stopper 2*b* makes contact with the grooves 13*b* and 14*b* (see FIG. 1) of the second thread tension disc 13 and the spring bearing 14 so as to also block rotations of the second thread tension disc 13 and the spring bearing 14.

Spring constants of the thread tension spring 15 and the operation stability spring 18 may be desirably the same. At this time, however, the spring constants of the thread tension spring 15 and the operation stability spring 18 may be different. A spring load F1 max of the thread tension spring 15 when the needle thread tension is at the maximum and a spring load F2 max of the operation stability spring 18 when the needle thread tension is at the minimum are both specified to be a value F max. In addition, a spring load F1 min of the thread tension spring 15 when the needle thread tension is at the minimum and a spring load F2 min of the operation stability spring 18 when the needle thread tension is at the maximum are both specified to be a value F min. According to the present embodiment, the value F min is specified to be zero.

In order to increase the needle thread tension, the user of the sewing machine 1 moves the presser foot lever 6 (see FIG. 1) upwardly so that the needle thread 4 is inserted into a gap formed between the first and second thread tension discs 12 and 13. Then, the user returns the presser foot lever 6 to the original position thereof so as to hold the needle thread 4 between the first and second thread tension discs 12 and 13. Next, in order to obtain the desired needle thread tension, the user rotates the thread tension dial 19 in the upper direction (the first direction) in FIG. 1 about the axis P, for example. The tension setting nut 16 then moves in the axial direction in a state where the internal thread portion 16*d* is meshed with the external thread portion 11*a* of the shaft 11, in association with the rotation of the thread tension dial 19 by means of the engagement between the slide rail 19*d* and the slide rail groove 16*f* of the conversion mechanism 8. That is, the tension setting nut 16 rotates about the axis P and moves in the axial direction towards the spring bearing 14 (in the arrow X1 direction). The tension setting nut 16 moves in the axial direction relative to the shaft 11 while being meshed with the shaft 11 so as to approach the spring bearing 14. The aforementioned movement of the tension setting nut 16 is transmitted to the tension display portion 17 via the pair of notch recesses 16*e*, 16*e* and the pair of notch protrusions 17*c*, 17*c* of the engagement portion 7. As a result, the tension display portion 17 also moves in the spiral direction relative to the axis P by moving in the arrow X1 direction so as to approach the spring bearing 14 while rotating about the axis P. The length L1 of the thread tension spring 15 is reduced accordingly as illustrated in FIG. 3A. The spring load of the thread tension spring 15 applied to the second thread tension disc 13 via the spring bearing 14 thus increases. Further, the frictional force generated between the needle thread 4, which is held between the first and second thread tension discs 12 and 13, and the first and second thread tension discs 12 and 13 also increases to thereby increase the tension of the needle thread 4. On the other hand, a length L2 of the operation stability spring 18 is elongated to thereby decrease the spring load of the operation stability spring 18.

In order to decrease the needle thread tension, the user operates the thread tension dial 19 to rotate in the lower direction (the second direction) in FIG. 1 about the axis P. Then, the tension setting nut 16 and the tension display portion 17 move in a direction different from the direction where the tension setting nut 16 and the tension display portion 17 move to increase the needle thread tension. The tension setting nut 16 moves in the arrow X2 direction so as to be away from the spring bearing 14. The length L1 of the thread tension spring 15 is elongated to thereby decrease the spring load of the thread tension spring 15 applied to the second thread tension disc 13 via the spring bearing 14. Therefore, the frictional force between the needle thread 4 and the first and second thread tension discs 12 and 13 decreases, which leads to a decrease of the tension of the needle thread 4. At this time, the length L2 of the operation stability spring 18 is reduced so that the spring load thereof increases. As mentioned above, the user of the sewing machine 1 specifies the desired tension level of the needle thread 4 by rotating the thread tension dial 19 about the axis P.

Figure 15:
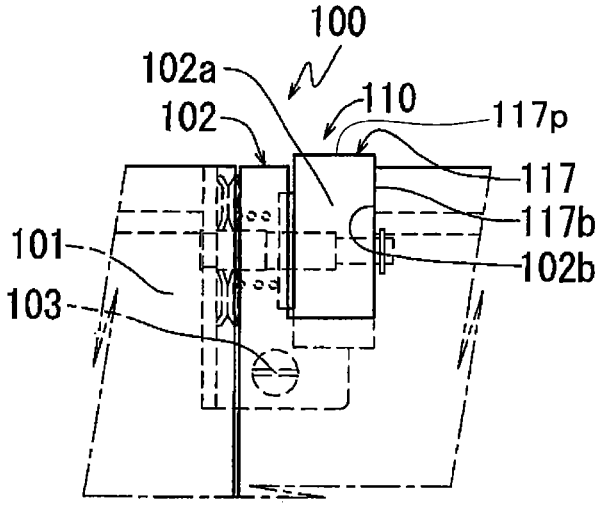
F I G. 15 Prior Art
FIG. 15 is a side view of a needle thread tension control device according to a known sewing machine.
Figure 16:
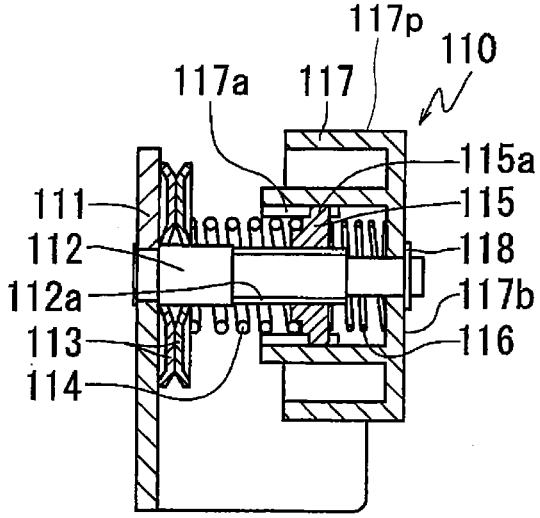
F I G. 16 Prior Art
FIG. 16 is a cross-sectional view of the needle thread tension control device according to the known sewing machine.

According to the known sewing machine 100 as illustrated in FIGS. 15 and 16, scale marks represented by the numeric values and indicating the needle thread tension setting level are displayed at the outer peripheral surface 117*p* of the operation dial 117 along the circumferential direction thereof. Thus, in order to inhibit overlapping of the scale marks at the outer peripheral surface 117*p* of the operation dial 117, a range of the needle thread setting level should correspond to one rotation (360°) of the operation dial 117. On the other hand, according to the present embodiment, the internal thread portion 16*d* moves relative to the external thread portion 11*a* of the shaft 11 while being meshed therewith so that the tension setting nut 16 moves in the spiral direction relative to the axis P. That is, the tension setting nut 16 moves in the axial direction along the shaft 11 while rotating in the circumferential direction about the axis P. As a result, the tension setting nut 16 moves towards the second thread tension disc 13 or away from the second thread tension disc 13. As mentioned above, in a case where the tension setting nut 16 moves in the spiral direction relative to the axis P while being meshed with the shaft 11 in association with the rotation of the thread tension dial 19, the tension setting nut 16 moves in the axial direction while rotating in the circumferential direction about the axis P. Thus, the needle thread tension setting level is displayed at the outer peripheral surface of the tension display portion 17, which integrally rotates with the tension setting nut 16, along the circumferential direction thereof corresponding to one rotation (360°) or more.

Figure 9:
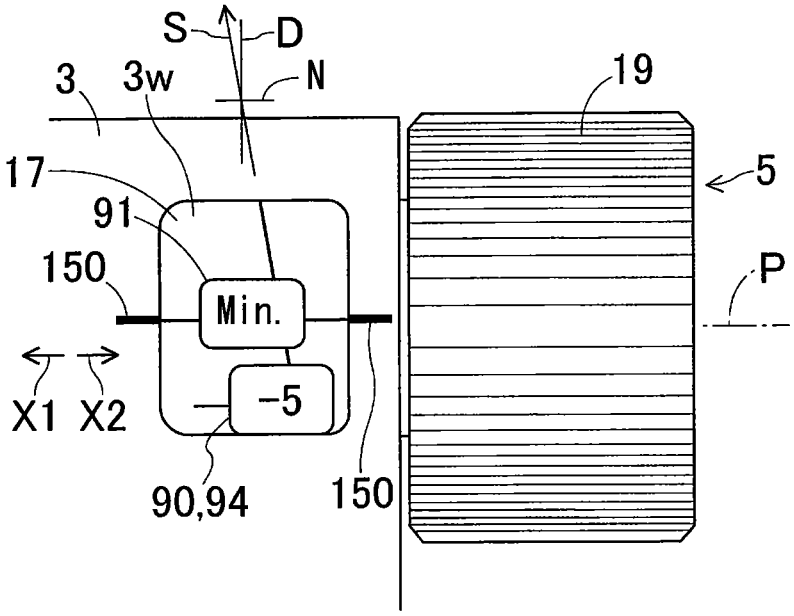
FIG. 9 is a diagram explaining a scale displayed at a display window.
Figure 10:
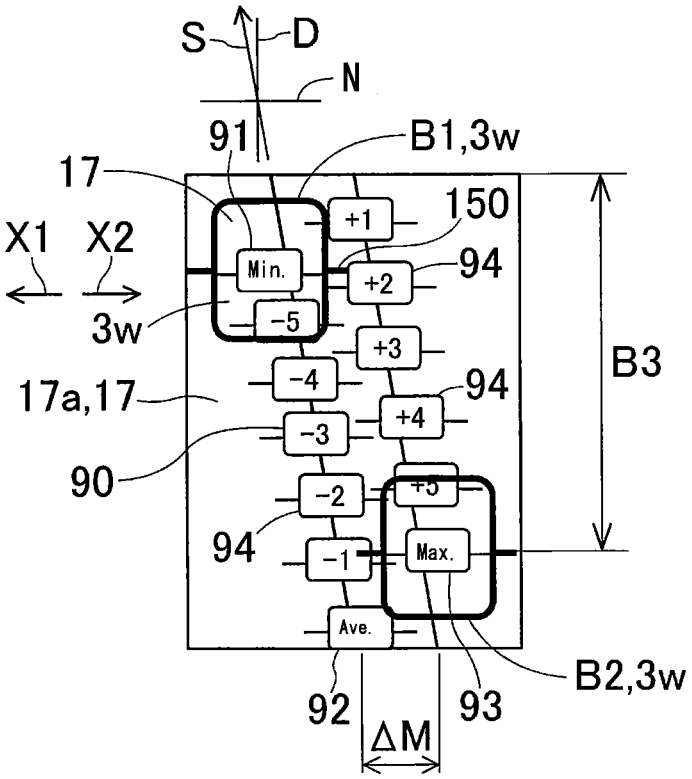
FIG. 10 is a development view of the outer peripheral surface of the cylindrical portion of the tension display portion according to the first embodiment.

As illustrated in FIG. 9, a reference mark 150 is formed in the vicinity of the display window 3*w* of the case 3. The reference mark 150 extends in a direction parallel to the axis P and extends in a horizontal direction when viewed by the user. As illustrated in FIG. 10, a scale 90 indicating a magnitude of the needle thread tension is provided along the spiral direction (an arrow S direction) relative to the axis P at the cylindrical portion 17*a* of the tension display portion 17. The scale 90 includes stepwise numerical values 94, serving as marks, from a minimum value 91 indicating a minimum tension value through an average value 92 indicating an average tension value to a maximum value 93 indicating a maximum tension value. The numerical values 94 of the scale 90 are positioned serially and side by side at the outer peripheral surface of the cylindrical portion 17*a* of the tension display portion 17 in the spiral direction relative to the axis P.

As illustrated in FIG. 10, the numerical values 94 of the scale 90 are arranged serially and side by side in the spiral direction. Thus, though the scale 90 including the numerical values 94 is arranged so as to be wound plural times on the outer peripheral surface of the cylindrical portion 17*a* of the tension display portion 17, plural winding portions of the scale 90 are separated by ΔM from each other in the axial direction. Thus, each of the numerical values 94 of the scale 90 is recognizable. As a result, a distance from a start point of the scale 90 (i.e., the minimum value 91) to an end point thereof (i.e., the maximum value 93) is not limited to a length corresponding to 360° and is specified to be a length corresponding to 360°×n. That is, the rotation angle of the tension display portion 17 is ensured to be 360° or greater. According to the present embodiment, the value n is equal to two (n=2) so that the rotation angle of the tension display portion 17 is 720°. Therefore, the rotation angle of each of the tension setting nut 16 rotating in association with the tension display portion 17 and the thread tension dial 19 is also 720°.

According to the present embodiment, the rotation angle of the tension display portion 17 about the axis P is 720°. Thus, as compared to the known sewing machine where the rotation angle of the operation dial is limited to 360°, the distance from the start (the minimum value 91) to the end (the maximum value 93) of the scale 90 is elongated. Further, because the thread tension dial 19 is rotatable by 720° (=360°×2), the movement distance of the tension setting nut 16 in the axial direction (the arrows X1 and X2 directions) increases. Accordingly, in a state where the maximum value of the needle thread tension is the same as the aforementioned known sewing machine, the tension of the needle thread 4 is finely adjusted and specified from the minimum value to the maximum value of the needle thread tension according to the present embodiment. The scale 90 may include a relatively great number of numerical values indicating the thread tension setting level to thereby finely adjust the needle thread tension.

In a case where the rotation angle of the thread tension dial 19 is 0° (the minimum value), the display window 3*w* displays a first range B1 as illustrated in FIG. 10. In a case where the rotation angle of the thread tension dial 19 is 720° (the maximum value), the display window 3*w* displays a second range B2 as illustrated in FIG. 10. A distance where the scale 90 is formed at the tension display portion 17 is basically twice as long as a distance B3 because n=2. In association with the rotational operation by the user relative to the thread tension dial 19, the display range displayed by the display window 3*w* changes from the first range B1 to the second range B2. At this time, in FIG. 10, the display window 3*w* seems to be movable, however, the display window 3*w* is fixed and the scale 90 of the tension display portion 17 moves, specifically, rotates relative to the display window 3*w* in the spiral direction (in the arrow S direction).

As illustrated in FIGS. 9 and 10, the reference mark 150 is formed in the vicinity of the display window 3*w* of the case 3. One of the numerical values 94 of the scale 90 that is positioned next to the reference mark 150 indicates the present needle thread tension. While the user is rotating the thread tension dial 19, the user visibly confirms that the scale 90 rotates in a vertical direction relative to the reference mark 150 (i.e., in a direction D in FIGS. 9 and 10) and moves in a horizontal direction (i.e., in a direction N in FIGS. 9 and 10). At this time, any of the numerical values 94 of the scale 90 appearing from an upper-left side or from a lower-right side of the display window 3*w* and then being positioned next to the reference mark 150 corresponds to the present needle thread tension. Such numerical value 94 is positioned in a substantially center of the display window 3*w*.

Figure 11:
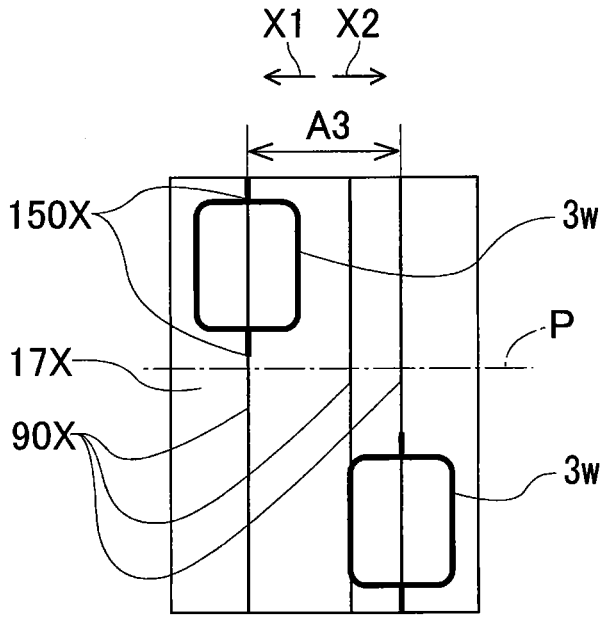
FIG. 11 is a development view of the outer peripheral surface of the cylindrical portion of the tension display portion according to a comparison example.

The scale 90 may be considered to be arranged in the circumferential direction instead of the spiral direction relative to the axis P at the outer peripheral surface of the tension display portion 17. In this case, as illustrated in FIG. 11 as a comparison example, a reference mark 150X is formed along the vertical direction when visibly seen by the user, in the vicinity of the display window 3*w*. In addition, a tension display portion 17X rotates about the axis P while moving by a stroke A3 along the axis P in the arrow directions X1 and X2. In the aforementioned comparison example, a scale 90X is provided at the outer peripheral surface of the tension display portion 17X in the circumferential direction thereof relative to the axis P instead of the spiral direction. In the same way as the first embodiment, in association with the rotational operation by the user relative to the thread tension dial 19, the tension display portion 17X moves in the arrow X1 or X2 direction by the stroke A3 along the axis P while rotating about the axis P. The scale 90X seems to horizontally move in the arrow X1 or X2 direction relative to the reference mark 150X. A distance from a start of the scale 90X (a minimum value serving as a minimum tension value) to an end thereof (a maximum value serving as a maximum tension value) corresponds to a length of the stroke A3. As a result, fine setting of the tension level of the needle thread 4 from the minimum value to the maximum value may be limited in the same way as the aforementioned known sewing machine 100, for example.

Figure 12:
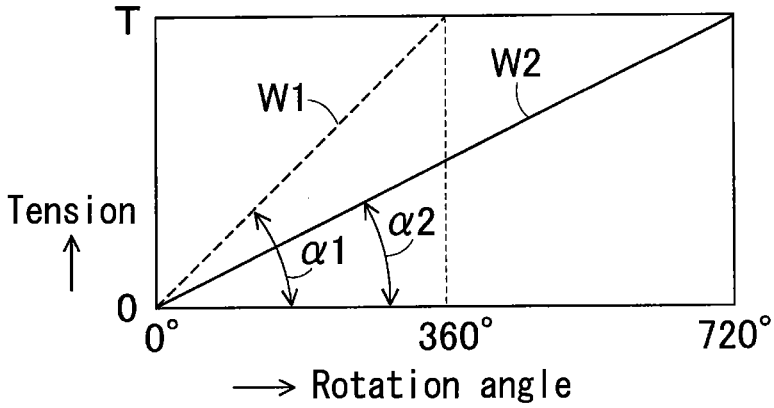
FIG. 12 is a graph illustrating characteristics of the needle thread tension according to the first embodiment.

FIG. 12 illustrates needle thread tension characteristics. The known sewing machine where the rotational operation of the operation dial (the thread tension dial) is 360° represents a first characteristic line W1 in a state where the maximum needle thread tension is specified to be a value T. According to the first characteristic line W1, a change in the needle thread tension relative to the rotational operation of the operation dial (the thread tension dial) is defined to be a change level $\alpha$1. On the other hand, the sewing machine 1 of the present embodiment where the rotational operation of the thread tension dial 19 is 360°×2 (720°) represents a second characteristic line W2 in a state where the maximum needle thread tension is also specified to be the value T. According to the present embodiment, as illustrated by the second characteristic line W2, the rotation angle of the thread tension dial 19 is specified to be 720°. Therefore, the tension setting nut 16 and the tension display portion 17 both rotate by 720°. A change in the needle thread tension relative to the rotational operation of the thread tension dial 19 is defined to be a change level $\alpha$2 ($\alpha$2<$\alpha$1) that indicates mild characteristics as shown by the second characteristic line W2. The scale 90 is finely specified accordingly. Because the tension setting nut 16 of the present embodiment is rotatable one rotation or more, a lead angle of the external thread portion 11*a* of the tension setting nut 16 is reduced as compared to the spring retainer 115 of the known sewing machine 100 in a case where the range of the needle thread tension from the minimum value to the maximum value is the same as the known sewing machine 100. The change in the needle thread tension relative to the rotational operation of the thread tension dial 19 is mild and the rotational force to move the tension setting nut 16 is reduced while the maximum value of the needle thread tension is ensured to be a certain value (a predetermined value) as compared to the known sewing machine. A rotation torque of the thread tension dial 19 is therefore reduced. Consequently, the change in the needle thread tension is mild while the rotation torque of the thread tension dial 19 is reduced so that the fine adjustment of the needle thread tension is achieved.

In addition, according to the present embodiment, the two groups of notch recesses, each of which is formed by the plural notch recesses 16*e* and of which distances to the surface 16*ba* where the thread tension spring 15 is pressed are different from one another, are formed at the end surface of the cylindrical portion 16*a* of the tension setting nut 16. The two groups of notch recesses are displaced by 180° on the identical circumference. The pair of notch protrusions 17*c*, 17*c*, engaging with one of the pairs of notch recesses 16*e*, 16*e* are formed at the inner peripheral surface of the cylindrical portion 17*a* of the tension display portion 17. During assembly in a factory or maintenance, a fine adjustment hook 17*j* (see FIGS. 3A and 3B) provided at the tension display portion 17 is picked or held by an operator so that one of display grooves 17*d* matches an indication groove 3*a* formed at the case 3. Then, the pair of notch recesses 16*e*, 16*e* is brought to engage with the pair of notch protrusions 17*c*, 17*c* of the tension display portion 17 so that the spring load of the thread tension spring 15 achieves a target needle thread tension (a predetermined needle thread tension). Accordingly, a relative position between the tension setting nut 16 and the tension display portion 17 is adjustable in the arrows X1 and X2 directions. At the time of assembly or maintenance of the sewing machine 1, for example, a fine adjustment is obtained to thereby absorb variations in a free length and a spring constant of the thread tension spring 15, and variations in dimensions of the tension setting nut 16, the tension display portion 17, the spring bearing 14, and the first and second thread tension discs 12 and 13. As a result, the sewing machine 1 including the needle thread tension control device 5 that has a fine adjustment function is achieved so as to determine a necessary needle thread tension adjustment range when the sewing machine 1 is assembled at a factory or during the maintenance of the sewing machine 1.

[Second Embodiment]

Figure 13:
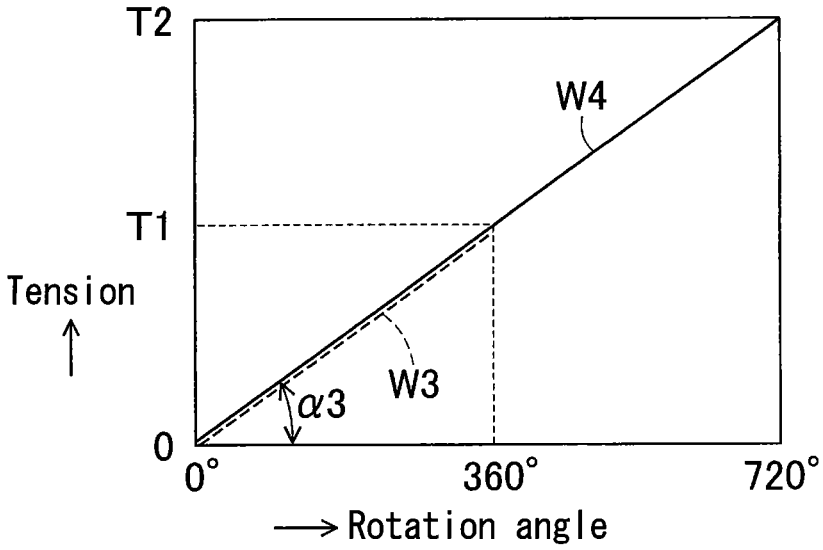
FIG. 13 is a graph illustrating characteristics of the needle thread tension according to a second embodiment.

A second embodiment basically includes the same configuration and effect as those of the first embodiment. Therefore, the second embodiment will be also explained with reference to FIGS. 1 to 11. According to the second embodiment, as well as the first embodiment, the distance from the start to the end of the scale 90 is elongated. FIG. 13 illustrates needle thread tension characteristics according to the second embodiment. The known sewing machine where the rotational operation of the operation dial (the thread tension dial) is 360° represents a third characteristic line W3 in a state where the maximum needle thread tension is specified to be a value T1. According to the third characteristic line W3, a change in the needle thread tension relative to the rotational operation of the operation dial (the thread tension dial) is defined to be a change level $\alpha$3. On the other hand, the sewing machine of the second embodiment represents a fourth characteristic line W4 in a state where the rotational operation of the thread tension dial 19 is 360°×2 (720°) while the change in the needle thread tension relative to the rotational operation of the thread tension dial 19 is specified to be the change level $\alpha$3 same as the known sewing machine. Because the change level $\alpha$3 of the needle thread tension relative to the rotational operation of the thread tension dial 19 is the same as the change level of the known sewing machine, the maximum needle thread tension is defined to be a value T2 (basically, T2=T1×2) according to the second embodiment. As compared to the known sewing machine (of which the maximum needle thread tension is T1), the maximum value of the needle thread tension is doubled. According to the second embodiment, thick cloth or fabric, or multi-folded cloth or fabric is easily sewn. Further, the tension adjustment range increases to a range from 0 to T2. According to the sewing machine of the second embodiment, the characteristic lines W2 or W4 is selectable.

[Third Embodiment]

Figure 14:
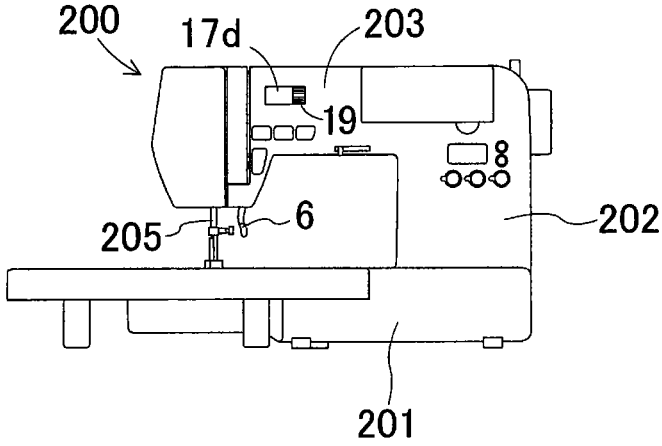
FIG. 14 is a front view of a sewing machine according to a third embodiment.

A third embodiment will be explained with reference to FIG. 14. The third embodiment basically includes the same configuration and effect as those of the first embodiment and thus will be also explained with reference to FIGS. 1 to 13. According to the third embodiment, the distance from the start to the end of the scale 90 is also elongated. A sewing machine 200 includes a work supporting bed 201, a vertical arm 202 vertically extending from an end of the work supporting bed 201, and a lateral arm 203 laterally extending from a top end of the vertical arm 202. The work supporting bed 201, the vertical arm 202, and the lateral arm 203 constitute the base member of the sewing machine. The lateral arm 203 includes a needle bar 205 to which a needle is attached, the presser foot lever 6 for lifting and lowering the needle bar 205, and the needle thread tension control device.

According to the aforementioned first to third embodiments, the spiral movement member is constituted by the tension setting nut 16 including the internal thread portion 16*d* and the tension display portion 17 where the scale 90 is arranged in the spiral direction. Alternatively, the tension display portion 17 may be omitted and the scale 90 (specifically, the numerical values 94) may be arranged serially and side by side in the spiral direction at the outer peripheral surface of the tension setting nut 16 including the internal thread portion 16*d* so that the scale 90 is exposed from the display portion 3*w*. The first to third embodiments are not limited to have the aforementioned configurations and may be appropriately modified or changed.

According to the aforementioned embodiments, the numeral values 94 of the scale 90 indicating the magnitude of the needle thread tension are arranged serially and side by side at the tension display portion 17 in the spiral direction relative to the axis P. As a result, the distance from the start to the end of the scale 90 is elongated, thereby achieving the range corresponding to one rotation or more (360° or more) so as to display the needle thread tension level.

In addition, according to the aforementioned embodiments, the spiral movement member includes the tension setting nut 16 coaxially held by the shaft 11 to rotate about the axis P and movable at both sides in the axial direction, and the tension display portion 17 operating in association with the tension setting nut 16, the tension setting nut 16 including the internal thread portion 16*d* while the tension display portion 17 including the scale 90 exposed from the display window 3*w*.

In a case where the tension setting nut 16 operates in association with the rotational operation of the thread tension dial 19, the tension setting nut 16 moves in the axial direction where the axis P extends while rotating in the circumferential direction about the axis P. At this time, because the numerical values 94 of the scale 90 indicating the magnitude of the needle thread tension are arranged serially and side by side at the tension display portion 17 in the spiral direction relative to the axis P, the distance from the start to the end of the scale 90 is not limited to the range corresponding to 360°. The distance from the start to the end of the scale 90 is elongated to be 360° or more accordingly.

Further, according to the aforementioned embodiments, the tension setting nut 16 includes the single or plural notch recesses 16*e* while the tension display portion 17 includes the single or plural notch protrusions 17*c* engageable with the single or plural notch recesses 16*e* and wherein the relative assembled position between the tension setting nut 16 and the tension display portion 17 is adjustable in a direction parallel to the axis P and the spring load of the thread tension spring 15 is adjustable by the engagement between the single or plural notch recesses 16*e* and the single or plural notch protrusions 17*c*.

At a time of assembly or maintenance, for example, the relative assembled position between the tension setting nut 16 and the tension display portion 17 is adjustable in the direction parallel to the axis P by the engagement between the pair of notch recesses 16*e*, 16*e*, and the pair of notch protrusions 17*c*, 17*c*. As a result, the spring load of the thread tension spring 15 is adjustable and therefore variations in the spring load of the thread tension spring 15 may be restrained.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A sewing machine comprising:

a base member; and a needle thread tension control device provided at the base member, the needle thread tension control device including:

a fixed portion fixed to the base member, the fixed portion having a display window displaying a needle thread tension;

a shaft fixed to the fixed portion in a state where a rotation of the shaft about an axis of the shaft is inhibited, the shaft including an external thread portion;

a first thread tension disc provided at a first end of the shaft in an axial direction;

a second thread tension disc provided at the shaft so as to be movable in the axial direction of the shaft, the second thread tension disc holding a needle thread with the first thread tension disc;

a thread tension dial provided at a second end of the shaft in the axial direction where the axis extends, the thread tension dial being rotatable about the axis; and a spiral movement member held at the shaft, the spiral movement member engaging with the thread tension dial to rotate in association with a rotation of the thread tension dial, wherein the spiral movement member includes an internal thread portion meshed with the external thread portion of the shaft, the spiral movement member being movable relative to the external thread portion in a spiral direction relative to the axis, wherein the spiral movement member includes a scale having marks arranged serially and side by side in the spiral direction relative to the axis to indicate a magnitude of the needle thread tension, wherein the spiral movement member is movable in two directions to adjust the needle thread tension by moving either towards or away from the second thread tension disc in the axial direction along the shaft while rotating in a corresponding circumferential direction of the spiral movement member about the axis by meshing between the external thread portion and the internal thread portion, wherein the spiral movement member displays the scale indicating a present needle thread tension by causing the scale to be exposed in the display window, and wherein a thread tension spring is arranged between the spiral movement member and the second thread tension disc, the thread tension spring applying respective biasing forces to the spiral movement member and the second thread tension disc in opposite directions from each other.

2. The sewing machine according to claim 1, wherein the spiral movement member includes a tension setting portion coaxially held by the shaft to rotate about the axis and is movable at both sides in the axial direction, and wherein the spiral movement member includes a tension display portion operating in association with the tension setting portion, the tension setting portion including the internal thread portion and the tension display portion including the scale exposed from the display window.

3. The sewing machine according to claim 2, wherein the tension setting portion includes a single or a plurality of first engagement portions, wherein the tension display portion includes a single or a plurality of second engagement portions engageable with the single or the plurality of first engagement portions, and wherein a relative assembled position between the tension setting portion and the tension display portion is adjustable in a direction parallel to the axis and a spring load of the thread tension spring is adjustable by the engagement between the single or the plurality of first engagement portions and the single or the plurality of second engagement portions.

4. The sewing machine according to claim 1, wherein an operation stability spring is disposed between the thread tension dial and the spiral movement member.

* * * * *